US006092591A

United States Patent [19]

McDonald et al.

[11] Patent Number: 6,092,591

[45] Date of Patent: Jul. 25, 2000

[54] TOP MOUNTING ARRANGEMENT FOR A HEAT EXCHANGE MODULE

[75] Inventors: John Anthony McDonald, Springfield, Mass.; Glenn Thomas Selby, Simsbury, Conn.

[73] Assignee: ABB Alstom Power Inc., Windsor, Conn.

[21] Appl. No.: 09/416,519

[22] Filed: Oct. 8, 1999

[51] Int. Cl.[7] ..... F28D 7/00

[52] U.S. Cl. ..... 165/162; 165/67; 165/145

[58] Field of Search ..... 165/162, 67, 145; 122/510

[56] References Cited

U.S. PATENT DOCUMENTS

| | | | |
|---|---|---|---|
| 2,090,345 | 8/1937 | Coy | 165/162 |
| 2,847,192 | 8/1958 | Smith et al. | 165/162 |
| 3,361,197 | 1/1968 | Mathews | 165/162 |
| 4,213,499 | 7/1980 | Straffi | 165/162 |
| 4,270,599 | 6/1981 | Connell | 165/162 |
| 4,671,343 | 6/1987 | Fukumoto | 165/162 |
| 4,895,204 | 1/1990 | Johnson et al. | 122/510 |
| 5,787,722 | 6/1998 | Jenkins | 165/162 |

*Primary Examiner*—Ira S. Lazarus
*Assistant Examiner*—Terrell McKinnon
*Attorney, Agent, or Firm*—Russell W. Warnock

[57] ABSTRACT

There is provided an arrangement for mounting the top end of a heat exchange module to and between a pair of opposed support frame surfaces, the arrangement including an elongate transverse beam and a pair of end mounting assemblies. The elongate transverse beam is securable to the top end of the heat exchange module with the longitudinal extent of the transverse beam oriented in the direction from one opposed support frame surface toward the other opposed support frame surface. One longitudinal end of the transverse beam has a left hand overextension portion extending longitudinally beyond the portion of the transverse beam immediately therebelow and the other longitudinal end of the transverse beam having a right hand overextension portion extending longitudinally beyond the portion of the transverse beam immediately therebelow. The pair of end mounting assemblies of the top end mounting arrangement are each securable to one of the opposed support frame surfaces to extend therefrom toward the other opposed support frame surface. Each end mounting assembly is operable to mount a respective longitudinal end of the transverse beam to a respective one of the opposed support frame surfaces.

5 Claims, 3 Drawing Sheets

TOP MOUNTING ARRANGEMENT FOR A HEAT EXCHANGE MODULE

BACKGROUND OF THE INVENTION

The present invention relates to an arrangement for mounting, on a support frame, the top end of a heat exchange module of a heat recovery steam generator and a method for mounting a heat exchange module in the supporting framework of a heat recovery steam generator.

According to U.S. Pat. No. 5,339,891, heat recovery steam generators have typically consisted of a vertically oriented heat exchanger comprising spirally-finned tubes located inside an externally supported box type structure. Further, according to the '891 patent, known modular arrangements typically comprise a finned tube heating surface that is bundled complete with top and bottom headers. The finned tube heating surface is shipped in a horizontal position and rotated at the erection site to a vertical orientation.

The modular finned tube heating surface acts as a heat exchanger to effect the exchange of heat from one fluid such as, for example, exhaust gas from a gas turbine, to another fluid such as water circulating in the tubes forming the finned tube heating surface. These heat exchanger modules are typically supported in a structural steel framework and one common approach to erecting these heat exchanger modules involves raising each modular heat exchanger above a bay formed within the structural steel framework and thereafter lowering the heat exchanger module into the bay. However, a drawback to this erection method is the need for a crane having sufficient height to lift the modular heat exchanger so that the bottom end of the modular heat exchanger clears the top of the bay. A crane with this capability may be unavailable or costly. Accordingly, the need exists for a mounting arrangement for a modular heat exchanger of a heat recovery steam generator which facilitates the installation of the heat exchanger module in the structural steel framework which supports it.

SUMMARY OF THE INVENTION

The present invention provides an arrangement for mounting, on a support frame, the top end of a heat exchange module of a heat recovery steam generator and a method for mounting a heat exchange module in the supporting framework of a heat recovery steam generator which facilitates the installation of the heat exchange modules in the structural steel framework which supports it.

According to one aspect of the present invention, there is provided an arrangement for mounting the top end of a heat exchange module to and between a pair of opposed support frame surfaces the arrangement including an elongate transverse beam and a pair of end mounting assemblies. The elongate transverse beam is securable to the top end of the heat exchange module with the longitudinal extent of the transverse beam oriented in the direction from one opposed support frame surface toward the other opposed support frame surface. One longitudinal end of the transverse beam has a left hand overextension portion extending longitudinally beyond the portion of the transverse beam immediately therebelow and the other longitudinal end of the transverse beam having a right hand overextension portion extending longitudinally beyond the portion of the transverse beam immediately therebelow.

The pair of end mounting assemblies of the top end mounting arrangement are each securable to one of the opposed support frame surfaces to extend therefrom toward the other opposed support frame surface. Each end mounting assembly is operable to mount a respective longitudinal end of the transverse beam to a respective one of the opposed support frame surfaces.

According to further details of the one aspect of the present invention, each end mounting assembly includes a lateral wing element and a bracket arm. Moreover, the lateral wing element preferably includes a pair of body portions joined at one end and spaced apart from one another at their opposite ends to form an open end slot therebetween. The open end slot of each lateral wing element is configured for insertion therein of one respective longitudinal end of the transverse beam such that the respective left or right hand overextension portion associated therewith is supported on the joined ends of the body portions of the lateral wing element with each body portion extending laterally outwardly from the transverse beam on a respective side thereof.

Additionally, in the preferred embodiment of the top end mounting arrangement of the one aspect of the present invention, the bracket arm includes one end securable to one of the opposed support frame surfaces such that the bracket arm extends toward the other opposed support frame surface and another end for mounting disposition with the lateral wing element. It is further additionally preferred that each bracket arm includes a pair of side flange portions each extending laterally outwardly to one respective side of the transverse beam for supporting thereon one of the laterally outwardly extending body surfaces of the respective lateral wing element supported by the bracket arm.

In accordance with a further preferred feature of the one aspect of the present invention, the top end mounting arrangement includes a pair of securement plates each mountable to a respective longitudinal end of the transverse beam at a spacing from the end mounting assembly associated therewith and to the one opposed support frame surface to which the respective longitudinal end of the transverse beam is to be mounted.

According to another aspect of the present invention, there is provided a method for mounting a heat exchange module in a support frame having a pair of opposed support frame surfaces such that the top end of the heat exchange module is secured to and between the opposed support frame surfaces. The method of mounting the heat exchange module in a support frame includes the steps of disposing the heat exchange module with an elongate transverse beam secured to the top end thereof at a mounting position in which the elongate transverse beam extends longitudinally between the opposed support frame surfaces, one longitudinal end of the transverse beam having a left hand overextension portion extending longitudinally beyond the portion of the transverse beam immediately therebelow and the other longitudinal end of the transverse beam having a right hand overextension portion extending longitudinally beyond the portion of the transverse beam immediately therebelow. The mounting method further includes the steps of positioning each one of a pair of a bracket arms for supporting a respective longitudinal end of the transverse beam such that the respective one of the left or right hand overextension portion of the longitudinal end of the transverse beam is supported on the bracket assembly. Also, the mounting method includes the step of securing each bracket assembly to one of the opposed support frame surfaces such that each bracket assembly extends therefrom toward the other opposed support frame surface.

DETAILED DESCRIPTION OF THE PREFERRED EMBODIMENT

Figure 1:
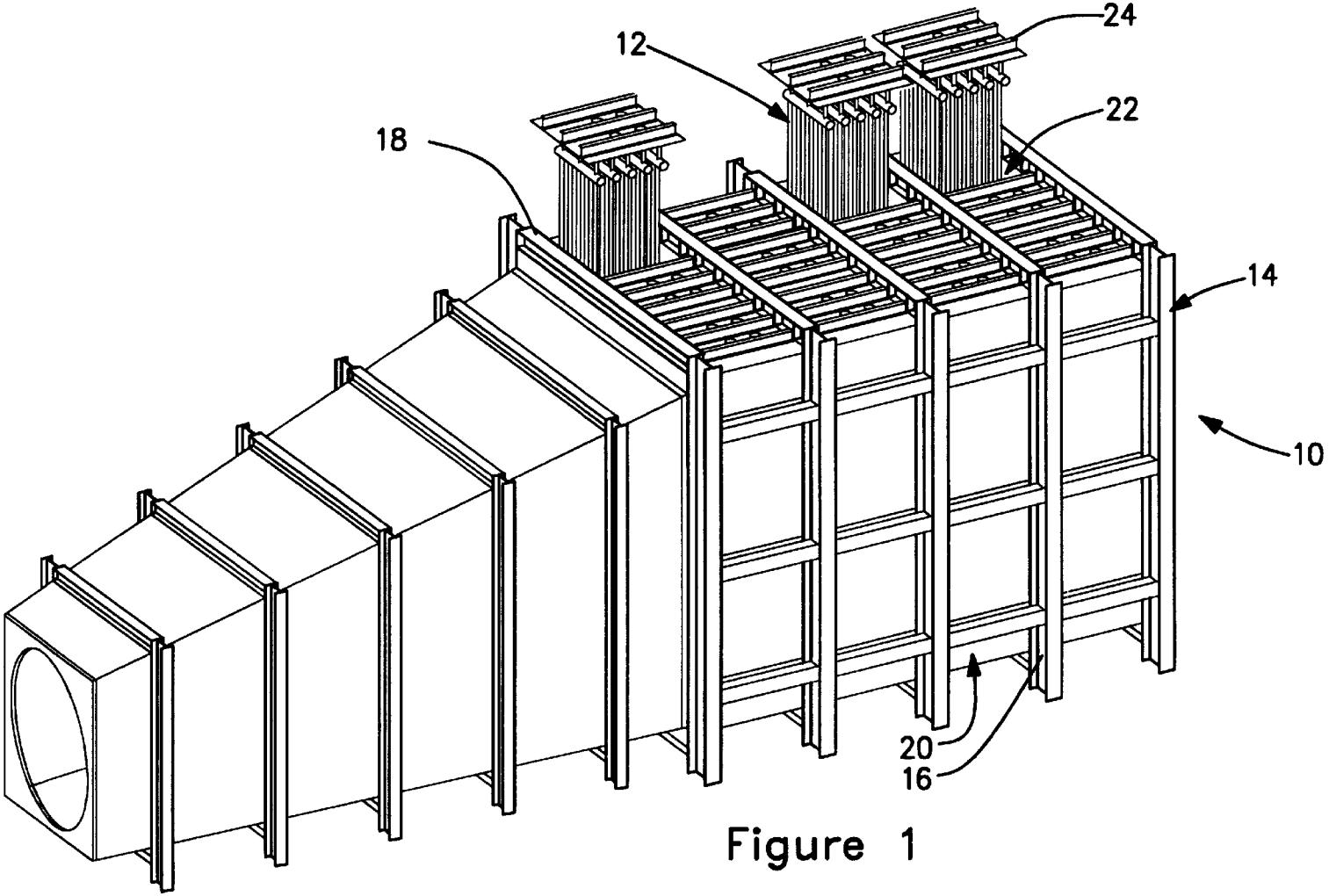
FIG. 1 is a perspective view of a heat recovery steam generator having the improved module mounting arrangement of the present invention.
Figure 2:
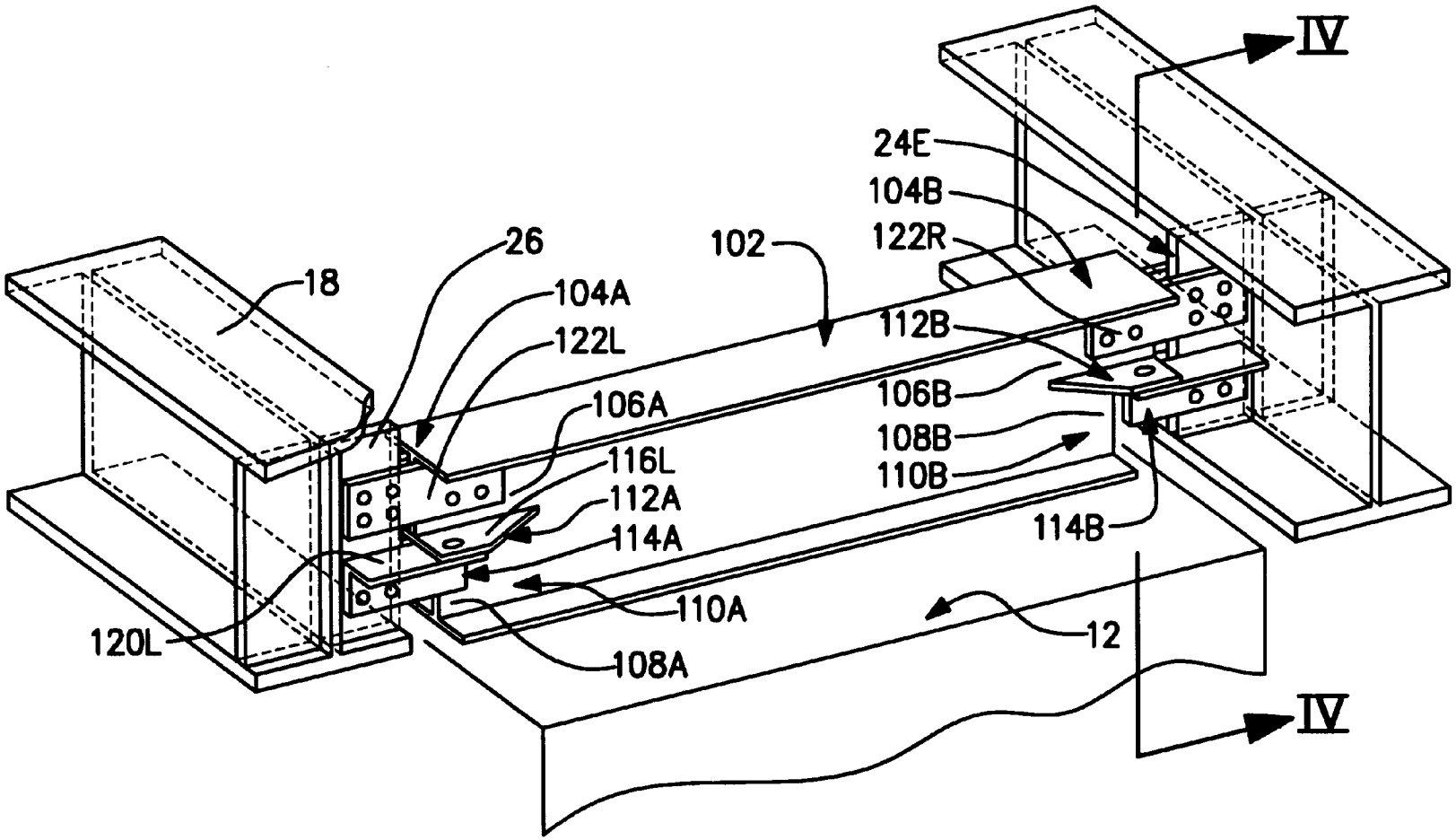
FIG. 2 is an enlarged perspective view of a portion of the heat recovery steam generator shown in FIG. 1 and showing a representative one of the module mounting arrangements.

Heat recovery steam generators are commonly deployed to use the heat content of an exhaust or waste gas such as, for example, the exhaust gas of a gas turbine. As seen in FIG. 1, a heat recovery steam generator 10 is comprised of a plurality of the heat exchanger modules 12 which are supported in a structural steel frame assembly 14. The structural steel frame assembly includes a plurality vertical steel posts 16 and roof girders 18 which form a framework for a casing 20 secured thereto. The casing 20 includes exterior wall portions and, in some circumstances, floor portions, which are typically fixedly connected to the vertical steel posts 16 and the roof girders 18 as well as interior wall portions some of which define, in cooperation with exterior wall and floor portions, a plurality of bays 22. The heat recovery steam generator 10 includes a module mounting arrangement 24 associated with each heat exchange module 12 which supports the heat exchange module in a fixed mounting position within a respective one of the bays 22. As best seen in FIG. 2. each roof girder 18 has an I-beam cross section comprised of top and bottom generally planar longitudinal sections in the form of flanges and a web interconnecting the top and bottom flanges along their longitudinal centerlines. Each roof girder 18 also includes a plurality of gussets 26 each of which projects perpendicularly from the web of the roof girder in a lateral direction with its top end connected to the underside of the top flange of the roof girder and its bottom end connected to the topside of the bottom flange of the roof girder.

A more detailed description of the module mounting arrangement will now be provided with reference to FIG. 2, which is an enlarged perspective view of a portion of the heat recovery steam generator shown in FIG. 1 which shows a representative one of the module mounting arrangements 24. As seen in FIG. 2, the representative module mounting arrangement—hereinafter generally designated as the representative module mounting arrangement 24E—mounts the top end of one of the heat exchange modules 12 to and between a pair of opposed support frame surfaces in a load bearing manner such that the weight of the heat exchange module is primarily borne by the representative module mounting arrangement 24E and other module mounting arrangements 24 which may also be secured to the respective heat exchange module. Merely for the purpose of describing the preferred embodiment of the representative module mounting arrangement 24E, the opposed support frame surfaces are representatively shown in FIG. 2 as being formed by a pair of adjacent roof girders. As will be described in more detail later, the opposed support frame surfaces to which the representative module mounting arrangement 24E is mounted in the exemplary mounting configuration shown in FIG. 2 are, more particularly, a pair of gussets 26 each of which is comprised in a respective one of the pair of adjacent roof girders 18.

The representative module mounting arrangement 24E includes an elongate transverse beam 102 securable to the top end of the heat exchange module 12 with the longitudinal extent of the transverse beam oriented in the direction from one opposed support frame surface toward the other opposed support frame surface. The representative module mounting arrangement 24E is exemplarily shown as a transverse beam having an "I" cross section comprised of top and bottom generally planar longitudinal sections and a web interconnecting the top and bottom longitudinal sections along their longitudinal centerlines. The transverse beam 102 includes a pair of opposed longitudinal ends 104A, 104B. The longitudinal end 104A of the transverse beam has a left hand overextension portion 106A extending longitudinally beyond a lower end portion 108A of the transverse beam immediately therebelow. The longitudinal end 104B of the transverse beam has a right hand overextension portion 106B extending longitudinally beyond a lower end portion 108B of the transverse beam immediately therebelow.

The representative module mounting arrangement 24E also includes a pair of end mounting assemblies 110A, 110B for mounting the longitudinal ends 104A, 104B, respectively, of the transverse beam 102 to the opposed support frame surfaces. In the heat recovery steam generator 10, which is illustrated and described herein merely for the purpose of portraying a typical heat recovery steam generator with which the module mounting arrangement of the present invention may be employed, the opposed frame surfaces are the adjacent pair of the roof girders 18 and each roof girder 18 includes a plurality of gussets 26. As will be described in more detail below, each end mounting assembly 110A, 110B is preferably securable to a respective gusset 26 on one of the roof girders 18. However, it is noted that the end mounting assemblies 110A, 110B can be mounted by any suitable manner to a roof girder. For example, in the event that the roof girder does not comprise a component such as the gusset 26 which extends to and between its top and bottom flanges, the end mounting assemblies 110A. 110B can instead be mounted to, for example, to a projection or other appurtenance of the roof girder. Moreover the projection or other appurtenance need not necessary provide another function such as a load gearing or reinforcing function but can, instead, be a structure provided solely for the purpose of effecting the mounting of an end mounting assembly 110A, 110B to the roof girder.

Figure 3:
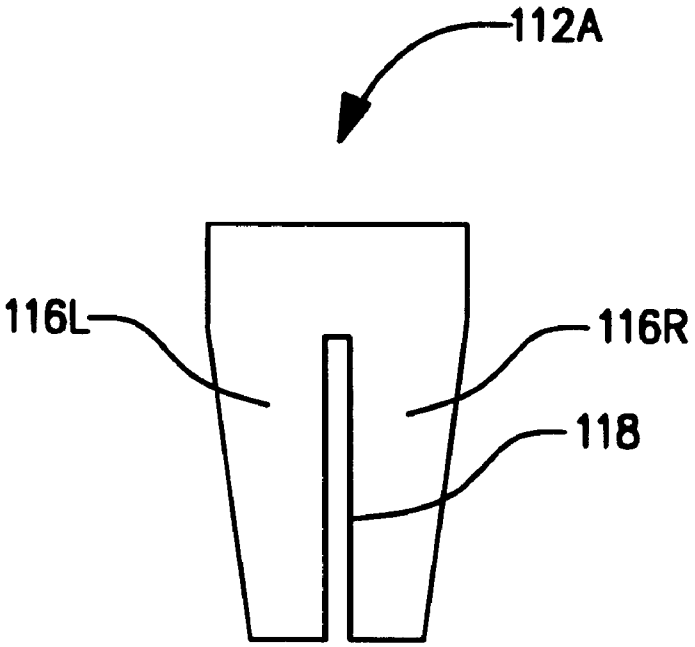
FIG. 3 is top plan view of a lateral wing element of the preferred embodiment of the module mounting arrangement of the present invention.

The end mounting assembly 110A includes a lateral wing element 112A and a bracket arm 114A. As seen in FIG. 3. which is an enlarged top plan view of the lateral wing element 112A, each of the lateral wing elements 112A, 112B has a pair of body portions 116L and 116R joined at one end and spaced apart from one another at their opposite ends to form an open end slot 118 therebetween. The open end slot 118 is configured to receive therein a longitudinal end of the transverse beam 102. For example, the longitudinal end 104A of the transverse beam 102 is received in the open end slot 118 of the lateral wing element 112A such that the left hand overextension portion 106A of the transverse beam 102 is supported on the joined ends of the body portions 116L, 116R of the lateral wing element 112A with each body portion extending laterally outwardly from the transverse beam 102 on a respective side thereof.

The end mounting assembly 110B includes a lateral wing element 112B and a bracket arm 114B. The lateral wing element 112B is identical to the lateral wing element 112A and therefore also has, as shown in FIG. 3, a pair of body portions 116L and 116R joined at one end and spaced apart from one another at their opposite ends to form an open end slot 118 therebetween. The open end slot 118 of the lateral wing element 112B is configured to receive therein the longitudinal end 104B of the transverse beam 102 such that the right hand overextension portion 106B associated therewith is supported on the joined ends of the body portions 116L, 116R of the lateral wing element 112B with each body portion extending laterally outwardly from the transverse beam 102 on a respective side thereof.

Figure 4:
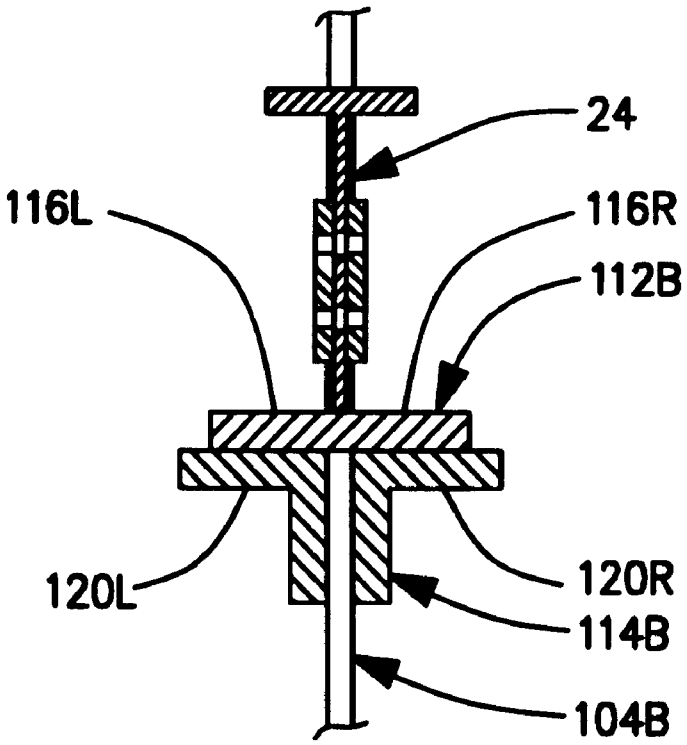
FIG. 4 is a vertical sectional view of one longitudinal end of the transverse beam of the module mounting arrangement, taken along lines IV—IV of FIG. 2.

Each bracket arm 114A, 114B has one end securable to a respective one of the opposed support frame surfaces (i.e., one of the girders flanges 26) such that the bracket arm extends toward the other opposed support frame surface and another end for mounting disposition with a respective one of the lateral wing elements 112A, 112B. As seen in FIG. 4, each bracket arm 114A, 114B is preferably in the form of a pair of side flange portions 120L, 120R each extending laterally outwardly to one respective side of the transverse beam 102 for supporting thereon one of the laterally outwardly extending body portions of the respective lateral wing element supported by the bracket arm. For example, as seen in FIG. 4, the side flange portion 120L of the bracket arm 114B supports thereon the body portion 116L of the lateral wing element 112B and the side flange portion 120R of the bracket arm 114B supports thereon the body portion 1 16R of the lateral wing element 112B.

As seen in FIG. 2, each module mounting arrangement 24 preferably additionally includes a pair of securement plates 122L, 122R each mountable at one end to the respective longitudinal end 104A, 104B of the transverse beam 102 associated with the module mounting arrangement 24. Each securement plate 122L, 122R is at a spacing from the end mounting assembly 110A, 110B associated with the respective longitudinal end 104A, 104B and is mountable at its other end to the one opposed support frame surface (the respective gusset 26) to which the respective longitudinal end 104A, 104B of the transverse beam 102 is mounted.

The module mounting arrangement 24 permits flexibility in the installation of the associated heat exchange module 12 for the reason that the module mounting arrangement 24 permits the heat exchange module to positioned in the respective bay 22 either through lowering of the heat exchange module 12 through the open top of the bay 22 or through raising of the heat exchange module 12 within the bay 22. The installation method of lowering the heat exchange module 12 into its associated bay 22 includes the sequential execution of the following steps. The transverse beam 102 is secured, for example, by bolting the lower flange of the transverse beam to the top of the heat exchange module 12, this step being performable at the manufacturing site at which the heat exchange module 12 is constructed or at the facility site at which the heat recovery steam generator 10 is to be permanently erected. At the facility site, the heat exchange module 12 with the module mounting arrangement 24 secured thereto is lifted by, for example, a crane and positioned such that the bottom end of the heat exchange module is above the open top end of the bay 22. Thereafter, the heat exchange module 12 is lowered into the bay 22. The bracket arms 114A, 114B can then be secured by bolts and/or welding to the respective pair of gussets 26 forming the opposed support surfaces across the open top end of the bay 22. Subsequently, the lateral wing elements 112A, 112B are disposed onto their supported disposition on the tops of the bracket arms 114A, 114B, respectively, and the remaining bolting and/or welding steps are performed to fixedly secure the transverse beam 102 to the gussets 26. If desired, the lateral wing elements 112A, 112B can be pre-secured to the transverse beam 102 at the manufacturing site by, for example, shop welding, prior to lifting and lowering of the heat exchange module 12 into the bay 22. The securement members 122L, 122R, if provided, are also secured to the transverse beam 102 and the gussets 26.

The alternate approach of raising the heat exchange module 12 within the bay 22 involves the sequential steps of disposing the heat exchange module 12 with the elongate transverse beam 102 secured to the top end thereof at a mounting position in which the elongate transverse beam 102 extends longitudinally between the opposed support frame surfaces. This step may be accomplished, for example, by raising the heat exchange module 12 within the area bounded by the already erected vertical posts 16 and the roof girders 18 by means of lift lines trained around pulleys which are mounted on the roof girders 18, by means of jacks supported on the ground and/or on the structural steel frame assembly 14, or by means of a crane lift line which is lowered through the open top of the bay 22 and retracted to thereby lift the heat exchange module 12.

The raised heat exchange module 12 is then disposed such that the longitudinal ends 104A, 104B of the transverse beam 102 are positioned for securement to the pair of gussets 26. This step involves positioning each one of the pair of bracket arms for supporting the respective longitudinal ends 104A, 104B of the transverse beam 102 such that the left hand overextension portion 106A of the longitudinal end 104A of the transverse beam 102 is supported on the bracket arm 114A and the right hand overextension portion 106B of the longitudinal end 104B of the transverse beam 102 is supported on the bracket arm 114B. To permit clearance of the transverse beam 102 as it is raised during the final upward movement of the heat exchange module 12, it is necessary to delay the installation of the bracket arms 114A, 114B until the transverse beam 102 has vertically cleared the locations at which the bracket arms will be secured. Each bracket arm 114A, 114B is thereafter secured to the respective one of the opposed support frame surfaces formed by the gussets 26 such that each bracket arm extends therefrom toward the other opposed support frame surface and the bracket arms 114A, 114B are also bolted to the transverse beam 102. Subsequently, the lateral wing elements 112A, 112B are disposed onto their supported disposition on the tops of the bracket arms 114A, 114B, respectively, and the remaining bolting and/or welding steps are performed to fixedly secure the transverse beam 102 to the gussets 26. As mentioned previously herein, depending upon clearance and lifting capability, the lateral wing elements 112A, 112B can be shop welded to the transverse beam 102 at the manufacturing site prior to lifting of the heat exchange module 12 into the bay 22. The securement members 122L, 122R, if provided, are also secured to the transverse beam 102 and the gussets 26.

While a preferred embodiment of the invention has been shown, it will be appreciated by those skilled in the art that modifications may readily be made thereto. It is, therefore, intended that the appended claims shall cover any modifications alluded to herein as well as to all modifications that fall within the true spirit and scope of the invention.

We claim:

1. An arrangement for mounting the top end of a heat exchange module to and between a pair of opposed support frame surfaces, comprising:

an elongate transverse beam securable to the top end of the heat exchange module with the longitudinal extent of the transverse beam oriented in the direction from one opposed support frame surface toward the other opposed support frame surface, one longitudinal end of the transverse beam having a left hand overextension on portion extending longitudinally beyond the portion of the transverse beam immediately therebelow and the other longitudinal end of the transverse beam having a right hand overextension portion extending longitudinally beyond the portion of the transverse beam immediately therebelow; and a pair of end mounting assemblies each securable to one of the opposed support frame surfaces to extend therefrom toward the other opposed support frame surface, each end mounting assembly for mounting a respective longitudinal end of the transverse beam to a respective one of the opposed support frame surfaces.

2. An assembly for mounting the top end of a heat exchange module to and between a pair of opposed support frame surfaces according to claim 1 wherein each end mounting assembly includes a lateral wing element and a bracket arm, the lateral wing element having a pair of body portions joined at one end and spaced apart from one another at their opposite ends to form an open end slot therebetween, the open end slot for insertion therein of one respective longitudinal end of the transverse beam such that the respective left or right hand overextension portion associated therewith is supported on the joined ends of the body portions of the lateral wing element with each body portion extending laterally outwardly from the transverse beam on a respective side thereof, the bracket arm having one end securable to one of the opposed support frame surfaces such that the bracket arm extends toward the other opposed support frame surface and another end for mounting disposition with the lateral wing element.

3. An assembly according to claim 2 wherein each bracket arm includes a pair of side flange portions each extending laterally outwardly to one respective side of the transverse beam for supporting thereon one of the laterally outwardly extending body surfaces of the respective lateral wing element supported by the bracket arm.

4. An assembly according to claim 3 and further comprising a pair of securement plates each mountable to a respective longitudinal end of the transverse beam at a spacing from the end mounting assembly associated therewith and to the one opposed support frame surface to which the respective longitudinal end of the transverse beam is to be mounted.

5. A method for mounting a heat exchange module in a support frame having a pair of opposed support frame surfaces such that the top end of the heat exchange module is secured to and between the opposed support frame surfaces comprising:

disposing the heat exchange module with an elongate transverse beam secured to the top end thereof at a mounting position in which the elongate transverse beam extends longitudinally between the opposed support frame surfaces, one longitudinal end of the transverse beam having a left hand overextension portion extending longitudinally beyond the portion of the transverse beam immediately therebelow and the other longitudinal end of the transverse beam having a right hand overextension portion extending longitudinally beyond the portion of the transverse beam immediately therebelow;

positioning each one of a pair of a bracket arms for supporting a respective longitudinal end of the transverse beam such that the respective one of the left or right hand overextension portion of the longitudinal end of the transverse beam is supported on the bracket assembly; and securing each bracket arm to one of the opposed support frame surfaces such that each bracket arm extends therefrom toward the other opposed support frame surface.

* * * * *